US008783057B2

(12) United States Patent
Nelson

(10) Patent No.: US 8,783,057 B2
(45) Date of Patent: Jul. 22, 2014

(54) REFRIGERANT DISTRIBUTOR

(75) Inventor: Bruce I. Nelson, Colville, WA (US)

(73) Assignee: Colmac Coil Manufacturing, Inc., Colville, WA (US)

( * ) Notice: Subject to any disclaimer, the term of this patent is extended or adjusted under 35 U.S.C. 154(b) by 629 days.

(21) Appl. No.: 12/932,247

(22) Filed: Feb. 22, 2011

(65) Prior Publication Data

US 2012/0210744 A1 Aug. 23, 2012

(51) Int. Cl.
*F25D 11/00* (2006.01)
*F25B 39/02* (2006.01)
*F28F 9/02* (2006.01)

(52) U.S. Cl.
CPC ..... *F25B 39/028* (2013.01); *F28F 9/027* (2013.01)
USPC ..... 62/430; 62/515; 62/527; 62/196.4; 165/110; 165/111; 165/114

(58) Field of Classification Search
CPC ..... F23B 39/028; F28F 9/027; F25D 13/00
USPC ..... 62/430, 196.4, 515, 525, 527; 165/174, 165/114, 110–111
See application file for complete search history.

(56) References Cited

U.S. PATENT DOCUMENTS

| | | | | |
|---|---|---|---|---|
| 1,718,312 | A | 6/1929 | Shipley | |
| 2,168,404 | A | 8/1939 | Grant | |
| 2,237,239 | A | 4/1941 | Smith | |
| 2,555,055 | A * | 5/1951 | Ort | 62/525 |
| 5,050,400 | A * | 9/1991 | Lammert | 62/278 |
| 5,242,016 | A * | 9/1993 | Voss et al. | 165/174 |
| 6,179,051 | B1 | 1/2001 | Ayub | |
| 7,121,102 | B2 | 10/2006 | Fijas et al. | |
| 7,819,177 | B2 * | 10/2010 | Beamer et al. | 165/174 |
| 7,967,060 | B2 * | 6/2011 | Trumbower et al. | 165/174 |
| 2008/0190134 | A1 * | 8/2008 | Khatib et al. | 62/525 |
| 2008/0202738 | A1 * | 8/2008 | Nelson et al. | 165/174 |
| 2009/0229282 | A1 * | 9/2009 | Taras et al. | 62/117 |
| 2010/0132400 | A1 * | 6/2010 | Sugiura | 62/500 |
| 2011/0259551 | A1 * | 10/2011 | Kasai et al. | 165/100 |
| 2013/0087204 | A1 * | 4/2013 | Beard | 137/1 |
| 2013/0340979 | A1 * | 12/2013 | Nelson | 165/104.26 |

FOREIGN PATENT DOCUMENTS

| | | |
|---|---|---|
| JP | 1-244260 | 9/1989 |
| JP | 6-11730 | 4/1994 |

* cited by examiner

*Primary Examiner* — Frantz Jules
*Assistant Examiner* — Martha Tadesse
(74) *Attorney, Agent, or Firm* — Paine Hamblen, LLP

(57) ABSTRACT

A refrigerant distributor is described and which includes a tank defining an internal cavity for receiving a source of refrigerant; an inlet conduit for delivering the source of the refrigerant to the internal cavity of the tank; a contaminant collection container coupled in fluid receiving relation relative to the internal cavity of the tank and in disposal fluid receiving relation relative to the inlet conduit; and a plurality of refrigerant distributor conduits coupled in fluid flowing relation relative to the internal cavity of the tank and which have a multiplicity of apertures having variable diametral dimensions and which facilitate a variable flow of the source of refrigerant out through the refrigerant distributor conduits as the volume of the refrigerant in the tank increases.

19 Claims, 6 Drawing Sheets

REFRIGERANT DISTRIBUTOR

TECHNICAL FIELD

The present invention relates to a Refrigerant Distributor, and more specifically to a Refrigerant Distributor which is useful with ammonia evaporator heat exchangers, and the like, and wherein the invention provides substantial equal distribution of liquid and vapor refrigerant to downstream cooling devices.

BACKGROUND OF THE INVENTION

The prior art is replete with numerous examples of various distributor designs employed in various refrigeration arrangements.

As a general matter, refrigeration evaporators have multiple parallel circuits which require some type of a device to evenly distribute equal amounts of refrigerant to each of the circuits. This "equal distribution" feature becomes critically important with evaporators that are fed by means of dry or so-called "direct" expansion. In this regard, and in a dry expansion system, it has been understood that the flow of refrigerant to the evaporator is controlled by an expansion valve operating either on a thermal-mechanical, that is thermostatic basis, or an electronic control principal. This expansion valve regulates the flow of refrigerant in response to the cooling load that is imposed on the evaporator.

With respect to earlier prior refrigerant evaporators, and especially direct expansion types, the refrigerant which is supplied experiences a pressure drop typically across the expansion valve, which in turn, normally produces some adiabatic boiling of the refrigerant. This adiabatic boiling results in a "flash gas" and a two phase fluid flow, that is, gaseous or vapor like refrigerant mixed with liquid refrigerant especially at the entrance to the evaporator circuits. The prior art distributor's function was to divide this mixture of vapor and liquid coming in from the expansion valve equally to the multiple parallel evaporator circuits. As the refrigerant passes through the evaporator circuits, it is boiled, that is evaporated, and then finally superheated. An equal amount of refrigerant distributed to the entrance of each of the circuits typically insures an equal amount of superheat at the exit of each of the same evaporator circuits. It has been well understood that uniform superheating of the refrigerant vapor at the exit of each circuit is needed for stable modulation of the expansion valve. The prior art has also taught that the equal distribution function of the distributor is also important to the proper operation of near-dry expansion evaporators. As with dry expansion systems, near-dry expansion also introduces a two phase mixture of liquid and vapor refrigerant at the entrance of the evaporator. However, unlike dry expansion, the refrigerant does not evaporate completely such that the condition of the refrigerant at the exit of the circuit is saturated or slightly "wet," that is, with only a small amount of liquid remaining. The prior art distributor designs have heretofore used pressure drop across an orifice plate and through small diameter distributor tubes, which are typically called "leads" to thoroughly mix the vapor and liquid refrigerant just prior to entering the evaporator circuits. Typically, orifice plates are selected for pressure drops of approximately 25 lbs per square inch, and distributor leads for a pressure drop of about 10 to 15 lbs per square inch. This has resulted in a total pressure drop across a distributor assembly of sometimes between about 35 to 40 lbs per square inch at the design refrigerant flow rate condition on which it is employed.

Those skilled in the art will recognize that ammonia is produced in large quantities for use in agriculture, power generation and other industries. It has also long been known that ammonia makes an excellent refrigerant with outstanding thermodynamic and heat transfer properties. Moreover, ammonia is naturally occurring and also has an Ozone Depletion Potential (ODP), and Global Warning Potential (GWP), of zero. In addition to the foregoing, ammonia has traditionally been used in industrial refrigeration, but it is finding wider acceptance in other applications such as air conditioning and the like. In this regard, it has long been known that ammonia is toxic and flammable. Therefore, it would be desirable to develop a refrigeration system employing ammonia and which would use a minimal charge inventory circulating in the system in order to avoid hazards should the refrigeration system be breached. Those skilled in the art will readily recognize that a smaller refrigerant charge in the refrigerant system translates to less risk in the event of a leak or a release of the refrigerant to the immediate ambient environment.

Because of the risks noted above, dry or near-dry expansion operations result in the smallest possible refrigerant charge in the evaporator itself, and also minimizes the refrigerant charge in various other parts of the refrigeration system, that being, the liquid lines, liquid receivers, and other components. In view of the wide interest in reducing refrigerant charges in ammonia systems solely for safety reasons, designers and operators of ammonia refrigeration systems have long been motivated to use dry expansion with ammonia as a refrigerant. One of the principal properties of ammonia which makes it desirable as a refrigerant is its high latent heat of vaporization. This physical property results in relatively low mass flow rates for a given cooling capacity. Lower mass flow rates means smaller liquid pipes, and pump sizes, and low pumping power. However, the low mass flow rate of ammonia also results in very small distributor orifice and lead sizes. The very small orifices and small lead sizes result in several serious operational problems which have yet to find acceptable solutions. These problems include, among others, the deposit of scale and dirt from the interior of pipes, valves, and vessels in various locations in a system. For example, this scale and dirt can partially or completely plug orifices and/or leads thereby blocking the flow of the refrigerant. In addition these small orifice sizes can result in the overall refrigeration design having a cooling range of operation that is relatively narrow, that is, the evaporator cannot be operated efficiently under cooling loads which are significantly higher or lower than the design condition of the evaporator. It has long been known that a typical effective operating range of only about 50% to 150% of the rated capacity of the distributor is usually available. In addition to the foregoing, and during hot gas defrosting of an evaporator, the flow of gas through the distributor is severely limited. The high pressure drop of the refrigerant hot gas can cause a number of problems including longer than desired defrost times and, vibration damage may occur in the form of cracks which form in the distributor leads.

In addition to the several problems noted above, compressor lubrication oil which is often used in ammonia refrigeration systems sometimes becomes mixed with the refrigerant. This lubrication oil is typically immiscible and becomes very viscous and "tar-like" at low temperatures. If these immiscible oils reach the expansion valve they can then be cooled to the evaporator temperature. At this temperature, they can foul the distributor orifice and/or distributor tubes resulting in improper operation of the distributor and reduced evaporator capacity.

Currently, conventional distributor designs provide no convenient means of separating and capturing these immiscible oils before they reach the distributor. In addition to all the shortcomings noted above, conventional distributor designs also require that the expansion valve be mounted in close proximity or directly on to the distributor. Consequently, this installation location causes the expansion valve to be typically located within the refrigerated space. In view of the risks associated with a leak of ammonia refrigerant, especially in a refrigerated space, earlier prior art designs have not been widely utilized because a refrigerant leak would tend to interrupt operations, cause product damage, and could cause injury to workers.

It has long been known that it would be desirable to provide an improved refrigerant distributor which may be utilized with an ammonia evaporator heat exchanger, and which avoids the detriments individually associated with the prior art devices and practices employed heretofore.

SUMMARY OF THE INVENTION

A first aspect of the present eventually relates to a refrigerant distributor which includes a tank defining an internal cavity for receiving a source of refrigerant which is in a liquid or gaseous phase, or a mixture of liquid gaseous phases; an inlet conduit for delivering the source of the refrigerant to the internal cavity of the tank, and wherein the inlet conduit has a first intake end, and a second exhaust end which is located within the internal cavity of the tank, and wherein the exhaust end is defined by an upper and lower exhaust aperture; a contaminant collection container coupled in fluid receiving relation relative to the internal cavity of the tank, and wherein the second exhaust aperture of the inlet conduit is disposed in fluid delivering relation relative thereto; and a plurality of refrigerant distributor conduits are coupled in fluid flowing relation relative to the internal cavity of the tank, and wherein each of the refrigerant distributor conduits has a first intake end, and a second exhaust end, and wherein the first intake end of the respective refrigerant distributor conduits are substantially vertically oriented within the internal cavity of the tank, and a multiplicity of apertures are formed in each of the first ends of the respective refrigerant distributor conduits, and wherein the multiplicity of apertures each have a cross-sectional dimension which diminishes when that cross-sectional dimension is measured from a location extending from the first intake end of the respective refrigerant distributor conduits, and in the direction of the second exhaust end thereof.

Still another aspect of the present invention relates to a refrigerant distributor which includes a source of a refrigerant to be supplied to the refrigerant distributor, and wherein the source of the refrigerant, which may be in a liquid, gaseous, or liquid and gaseous state, contains immiscible contaminates; a tank having a main body defined by a sidewall, and which further has opposite first and second ends, and wherein the tank additionally defines an internal cavity for receiving the source of the refrigerant which is in both a liquid and a gaseous phase, and wherein the main body is also defined by a horizontal axis and a vertical axis; an indexing plate attached to the main body of the tank, and which is mounted within the internal cavity thereof and which is further oriented in a predetermined, spaced, substantially parallel relationship relative to the horizontal axis of the tank; a multiplicity of refrigerant distributor conduits, each of which has a first end, which is affixed to the indexing plate, and further located within the internal cavity of the tank, and an opposite second end, which is located outside of the tank, and wherein the first end of each of the refrigerant distributor conduits are oriented in substantially parallel relation relative to the vertical axis of the tank, and are also oriented in predetermined spaced relation one relative to the others, and wherein at least some of first ends of the respective refrigerant distributor conduits provide a variable flow of refrigerant from the first to the second ends thereof; a contaminant collection container coupled in fluid flowing relation relative to the tank and vertically oriented relative thereto, and wherein the contaminant collection container has a first, opened end, which is located within the internal cavity, and is further perpendicularly oriented, and inwardly spaced from the sidewall which defines the tank, and an opposite second end, which is located outside of the tank, and wherein a releasable drain plug is affixed to the second end of the contaminant collection container; and an inlet conduit for delivering the source of the refrigerant to the internal cavity of the tank, and wherein the inlet conduit has a first intake end which is coupled in fluid receiving relation relative to the source of the refrigerant during a refrigeration cycle, and a second intake end which is coupled with the source of the refrigerant during a defrosting cycle, and wherein the inlet conduit has an opposite, second, exhaust end which is defined by a pair of exhaust apertures, and wherein the pair of exhaust apertures includes an upper exhaust aperture, and a lower exhaust aperture, and wherein the lower exhaust aperture is oriented in fluid delivering relation relative to the first, opened end of the contaminant collection container, and wherein any immiscible contaminants which are mixed with the source of refrigerant moves, under the influence of gravity, from the inlet conduit, and is received within the contaminant collection container, and wherein the source of the refrigerant passes, at least in part, through the upper and lower exhaust apertures, and into the internal cavity defined by the tank.

These and other aspects of the present invention will be described in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
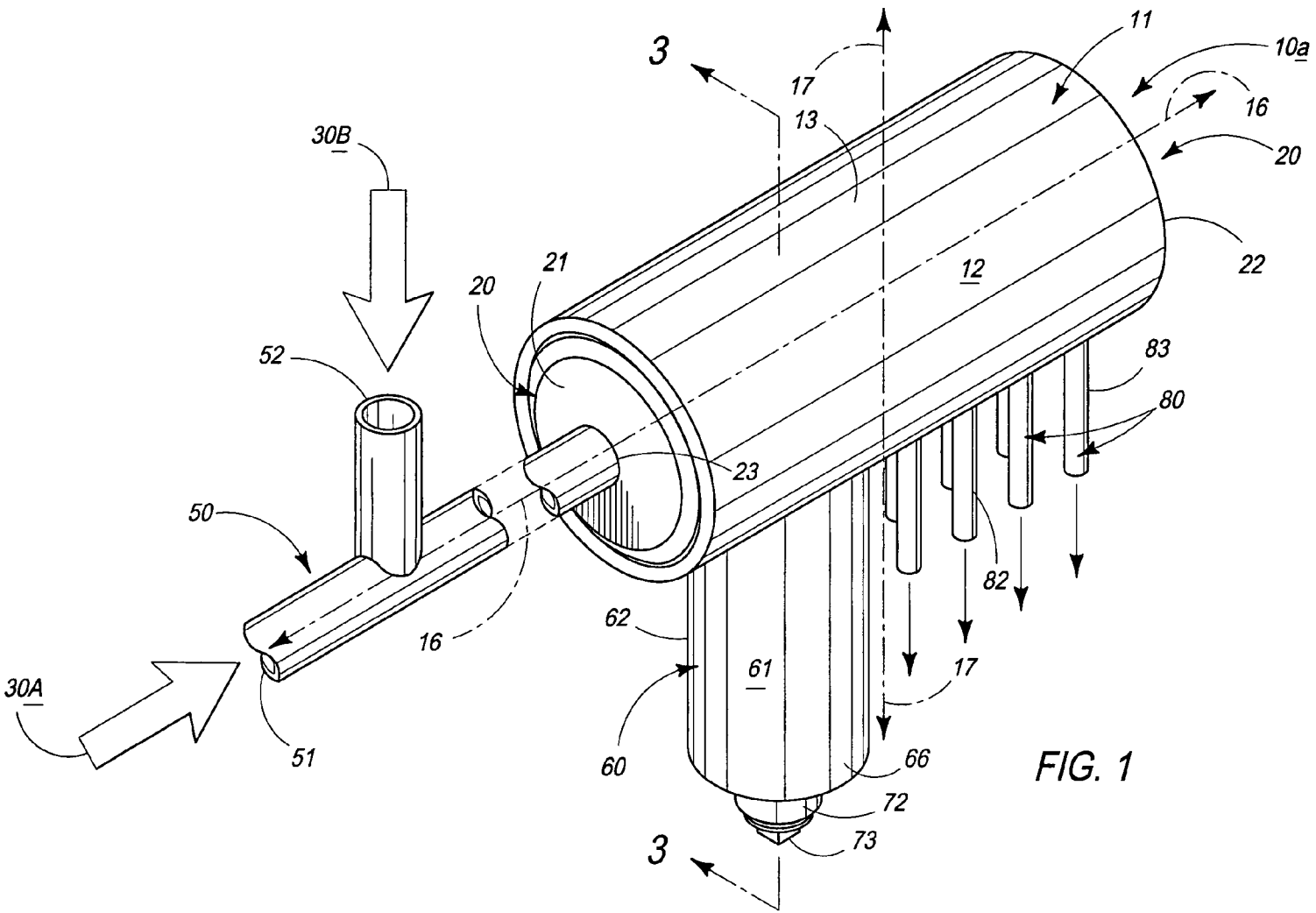
FIG. 1 is a perspective, side elevation view of a first form of the refrigerant distributor of the present invention.
Figure 2:
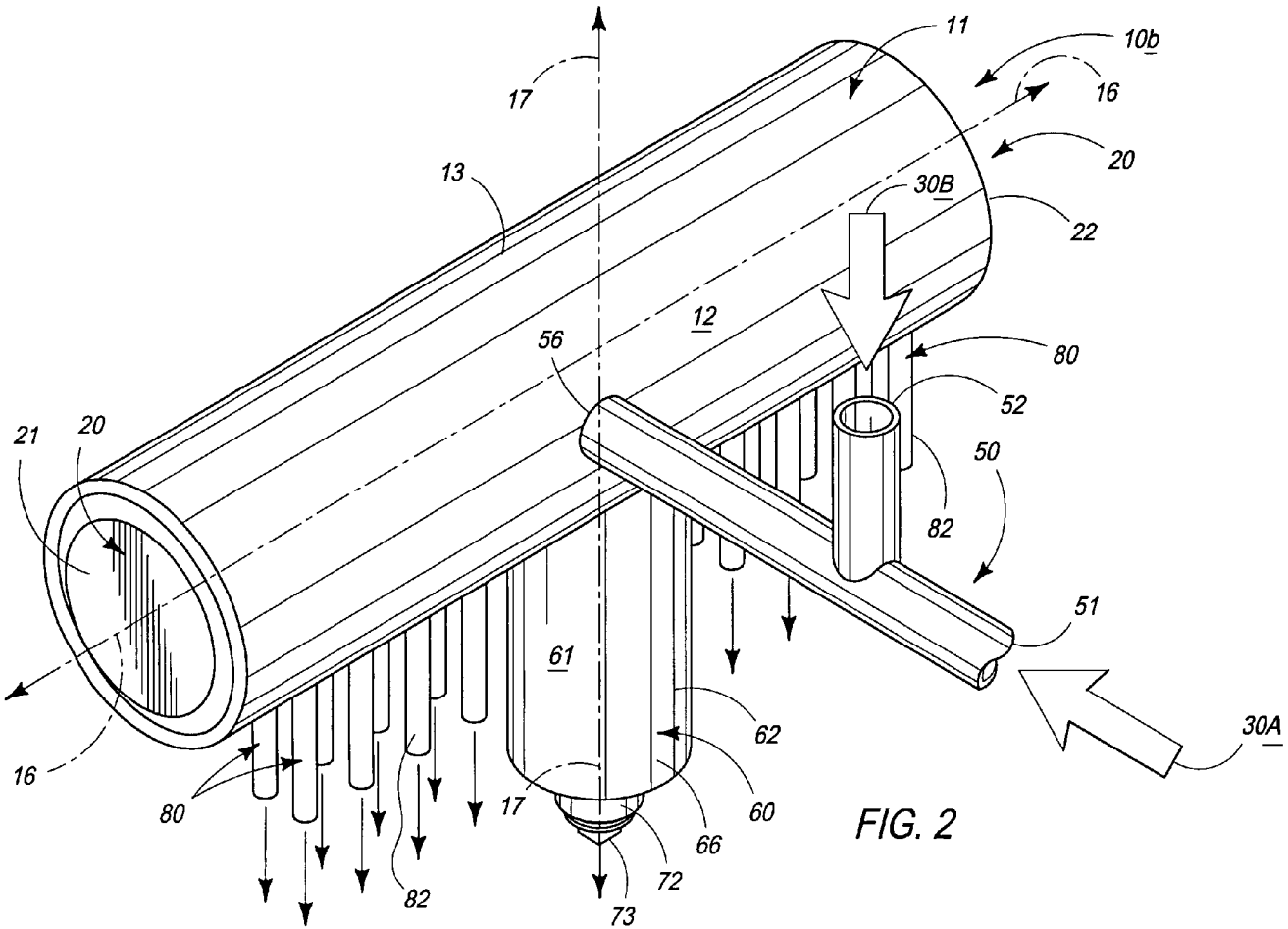
FIG. 2 is a perspective, side elevation view of a second form of the refrigerant distributor of the present invention.

A refrigerant distributor which embraces the teachings of the present invention is generally indicated by the numeral 10 in FIGS. 1 and 2. The first form of the present invention is designated by the number 10(*a*), and the second form of the invention is designated by the numeral FIG. 10(*b*), as seen in FIG. 2. In the paragraphs which follow it should be understood that similar numbers describe similar structures with regards to the two forms of invention as shown.

Figure 3:
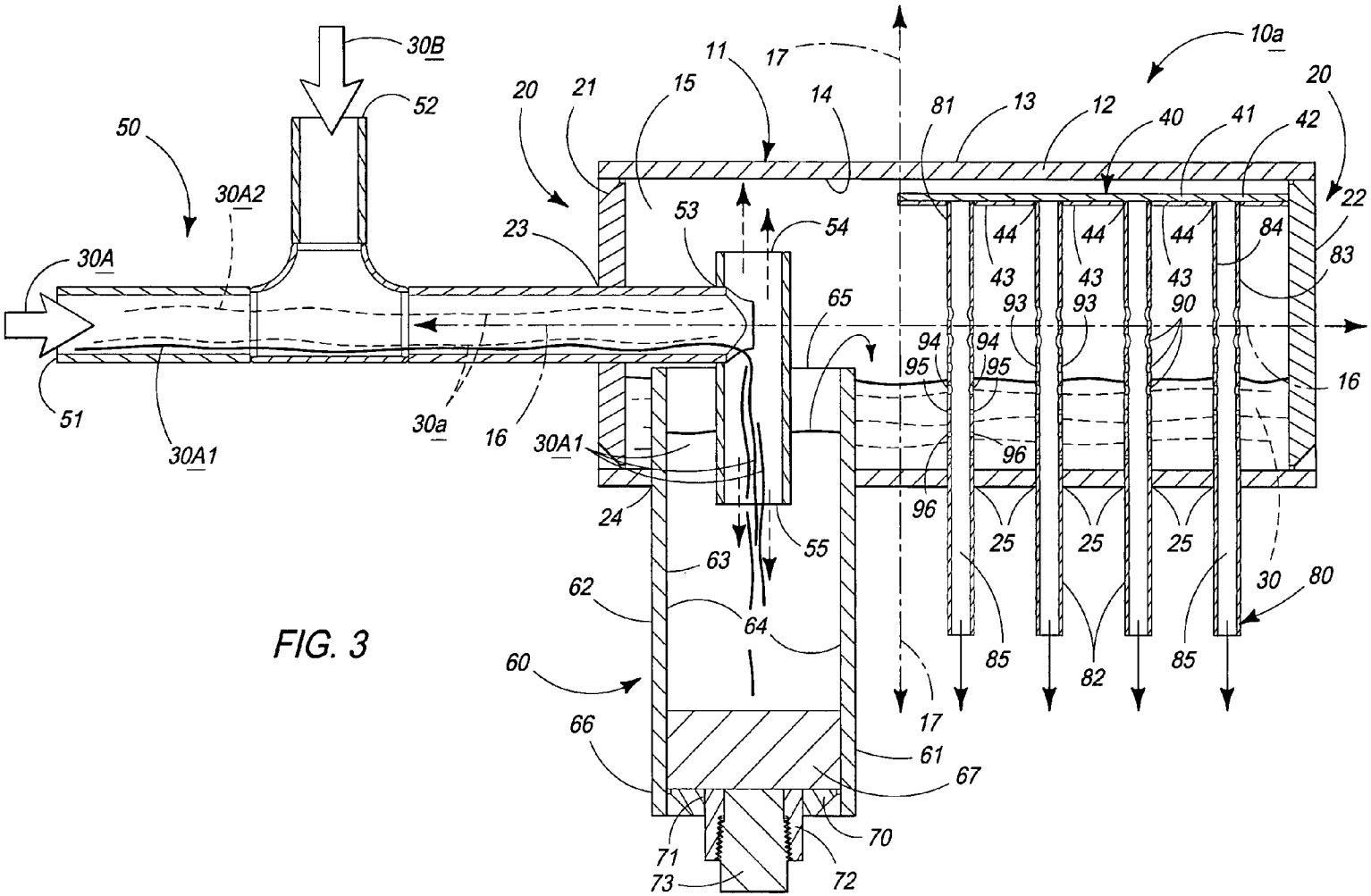
FIG. 3 is a longitudinal, vertical sectional view of the first form of the present invention and which is taken from a position along a line 3-3 of FIG. 1, and as it is seen during a typical refrigeration cycle.
Figure 4:
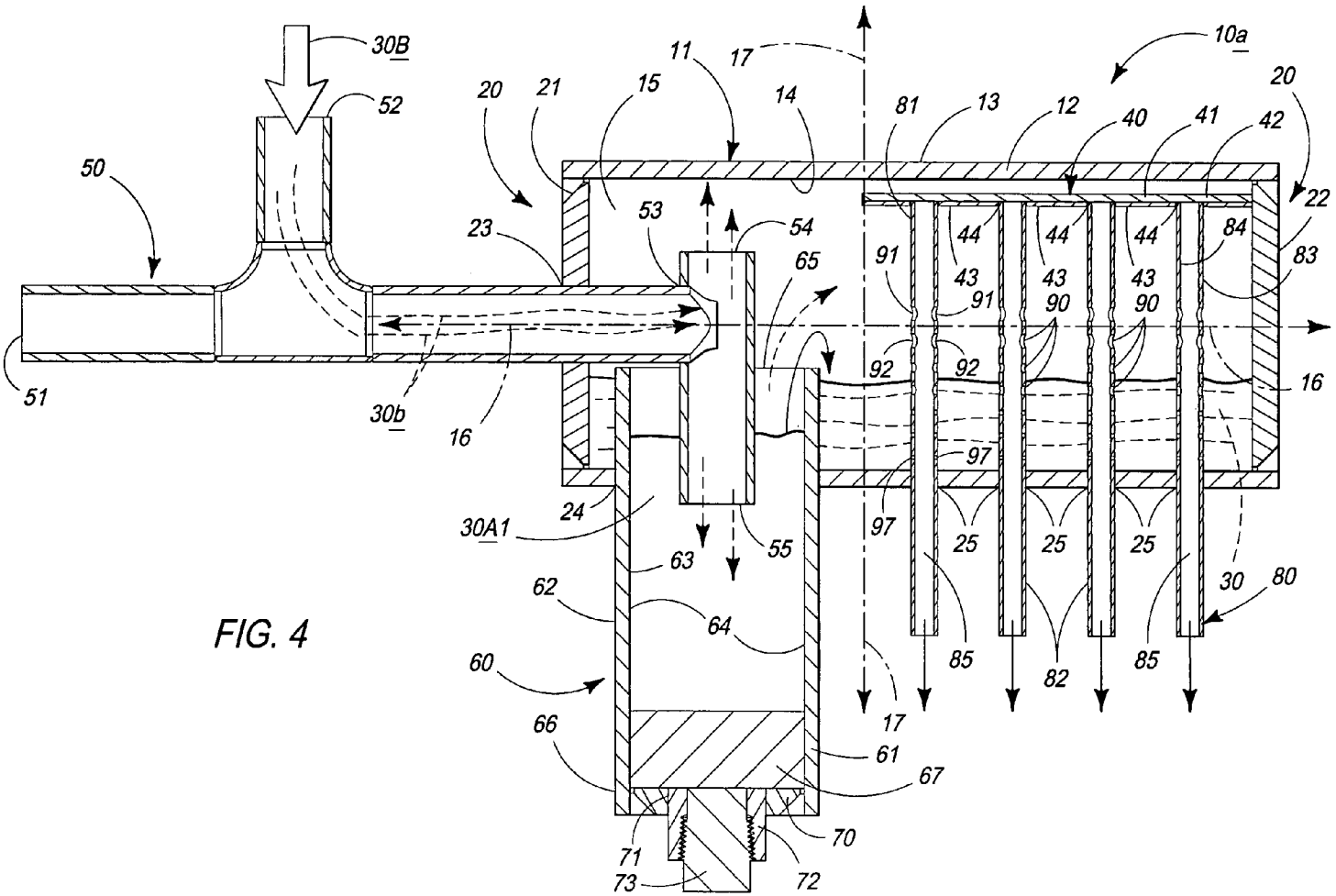
FIG. 4 is a second, longitudinal, vertical sectional view which is taken from a position along line 3-3 of FIG. 1, and which further shows the refrigerant distributor of the present inventor during a hot gas defrost cycle.
Figure 5:
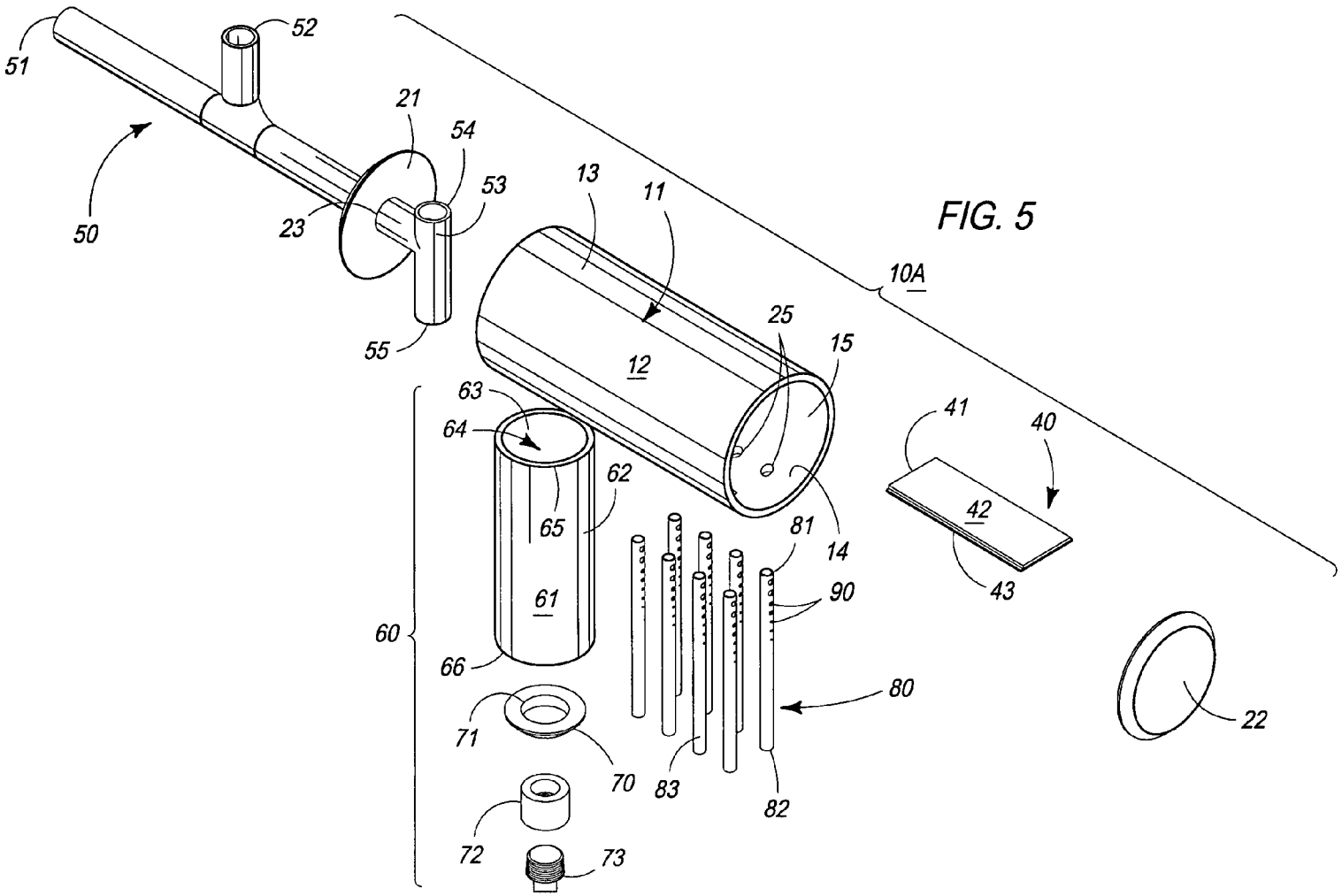
FIG. 5 is a perspective, exploded, side elevation view of the first form of the invention as seen in FIG. 1.

Referring now to FIGS. 1 through 4, respectfully, it will be understood that the present invention 10(*a*) and 10(*b*) includes, as a first feature, a tank which is generally indicated by the numeral 11. As seen in the drawings the tank is substantially elongated and typically assumes a cylindrical shape as depicted in these drawings. However, it should be recognized that while the drawings show a tank having a substantially cylindrical shape, other tank shapes may be employed with same. The tank as depicted has a main body 12, is substantially horizontally oriented or disposed. This is best seen in FIGS. 3 and 4. The tank 11 is defined by an outside facing peripheral surface 13, and an opposite inside facing peripheral surface 14. The inside facing surface 14 defines an internal cavity 15 having a given volume. As best seen by reference to FIGS. 1 and 2, the main body is defined by a generally longitudinally disposed axis 16, and a transversely disposed axis 17. Still referring to FIGS. 1 through 4, it will be seen that tank 11 includes opposite end walls 20. The tank 11 also has a first end 21, and an opposite second end 22. As seen in FIGS. 3 and 4, a first aperture 23 is formed in the first end wall 21 of the tank 11. This first aperture is substantially coaxial aligned relative to the longitudinal axis 16 of the main body 12. Still further, and formed in the main body 12 is an enlarged second aperture 24 for receiving, at least in part, a contaminant collection container which will be described in greater detail, hereinafter. Further, there is also formed in the main body 12 a plurality of spaced refrigerant distributor conduit apertures 25 which allow individual refrigerant distributor conduits to extend sealingly therethrough. Depending upon the form of the invention as seen in FIG. 1 or 2, these multiplicity of apertures may be oriented at given predetermined distances along the main body 12.

Referring now to FIGS. 1 and 2, again, it will be understood that the refrigerant distributor 10(*a*) or 10(*b*) of the present invention is coupled in fluid receiving relation relative to a source of refrigerant which is indicated by the numerals 30(*a*) and 30(*b*) respectively. The source of refrigerant 30A may be in a mixed liquid 30A1 and/or gaseous phase 30A2; or a gaseous phase 30(*b*). The refrigerant distributor 10 of the present invention, on the other hand, is then coupled in fluid delivering relation relative to a suitable cooling device (not shown) in a manner which is well understood in the art. It should be appreciated that the refrigerant distributor 10 of the present invention is operable to supply the source of the refrigerant 30(*a*) or 30(*b*) in substantially equal amounts to the various refrigerant circuits (not shown) in the downstream cooling device upon which it is utilized. This feature of the invention will be discussed in greater detail, hereinafter.

As seen in FIGS. 3 and 4, and in the first form of the invention 10(*a*) as depicted, the present invention includes an indexing plate 40 for supporting, at least in part, one end of a multiplicity of refrigerant distributor conduits as will be discussed in the paragraphs which follow. The indexing plate 40 is received within the internal cavity 15 of the tank 11. The indexing plate has a main body 41, which is defined by a top surface 42, and an opposite bottom surface 43. As best seen in FIGS. 3 and 4, a multiplicity of conduit receiving seats 44 are formed in the bottom surface 43, and are operable to receive or otherwise position the individual refrigerant distributor conduits in a given, spaced orientation relative to the longitudinal and transverse axes 16 and 17 of the tank 11. This feature of the invention will also be discussed, below.

Referring now to FIGS. 1 through 4 it will be understood that in the several forms of the invention as shown, each form includes an inlet conduit which is generally indicated by the numeral 50. Referring more specifically to FIGS. 1 and 3, it will be understood that the inlet conduit is operable to deliver the source of the refrigerant 30(*a*) or 30(*b*) to the internal cavity 15 of the tank 11. In the two forms of the invention as seen in these drawings, the inlet conduit 50 has a first intake end 51, which is coupled in fluid receiving relation relative to the source of refrigerant 30(A) during a refrigeration cycle; and a second intake end 52, which is coupled with the source of the refrigerant 30(B) during a hot-gas defrosting cycle. The inlet conduit 50 further has an opposite, T-shaped, second, exhaust end 53 which is defined by a pair or exhaust apertures, here depicted as an upper exhaust aperture 54, and an opposite, or bottom exhaust aperture 55. It should be appreciated from a study of the drawings that the source of the refrigerant, whether it is 30(A) or 30(B), may include immiscible components or elements which, if left within the overall refrigerant system, could eventually cause a malfunction of the downstream cooling device that is coupled with the refrigerant distributor, as described. As will be appreciated from the discussion, which will follow, this inlet conduit 50 facilitates, at least in part, the separation of these immiscible contaminants from the source of refrigerant 30(A) or 30(B) so as to enhance the operation of the downstream cooling assembly (not shown) which is coupled in fluid flowing relation relative to the refrigerant distributor 10. As seen by reference to this FIG. 1 it will be appreciated that the opposite, second, or exhaust end 53 of the inlet conduit 50 sealingly passes through the first aperture 23 which is formed in the first end wall 21 of the invention 10(*a*). In the second form of the invention 10(*b*) which is as seen in FIG. 2, the second or exhaust end 53 passes through an aperture 56, which is formed in the main body 12, and then enters the internal cavity 15 of the tank 11. The tank 11, as well as the inlet conduit 50, may be fabricated from a suitably selected steel or other rigid substrate, and the inlet conduit 50 is typically welded thereto so as to fluidly seal the inlet conduit 50 to the main body 12 thereof. As best depicted by reference to FIG. 3, it will be understood that the inlet conduit 50, and more specifically the opposite, or second exhaust end thereof 53, is oriented substantially coaxially along the longitudinal axis 16 of the tank 11. In the arrangement as seen in FIG. 3, for example, it will be understood that any immiscible contaminants which are mixed with the source of refrigerant 30(A) and which is in the liquid phase 30A1 thereof pass from the first intake end 51, to the opposite or second end 53, and would then travel, under the influence of gravity, downwardly through the lower exhaust aperture 55, and then be received, thereafter, in a contaminate collection container which will be discussed in greater detail hereinafter. The immiscible contaminants 67 can then settle-out and be subsequently removed from the refrigerant distributor 10(*a*) or 10(*b*) by an operator. Further, gaseous portions of refrigerant 30(*b*), which are supplied to the internal cavity 15 may then pass through the upper exhaust aperture 54, and thereafter be received in the internal cavity 15. Liquid refrigerant 30A1 received in the contaminant collection container, eventually fills same and then overflows into internal cavity 15 of the tank 11. Refrigerant 30 (whether in liquid or gaseous phase) which is received in the internal cavity 15 can then be distributed by means of the multiplicity of refrigerant distributor conduits, which will be described in greater detail, below.

Referring more specifically now to the longitudinal, vertical, sectional view as seen in FIG. 3, it will be understood that a contaminant collection container, which is generally indicated by the numeral 60, is made integral with, and is sealingly coupled in fluid receiving relation relative to the tank 11. The contamination collection container 60 is defined by a substantially cylindrically shaped main body 61 which is substantially vertically oriented, and which is positioned in substantially parallel, spaced relation relative to the vertical or transverse axis 17 of the tank 11. The contaminate collection container 60, and more specifically the main body 61, thereof, has an outside facing surface 62 which defines an outside diametral dimension which is sized so as to be received through the second aperture 24 which is formed in the main body 12 of the tank 11. The main body 61 of the contaminant collection container 60 is sealingly coupled thereto by welding or by some other suitable fastening technique. The main body 61 further has an inside facing surface 63 which defines an internal cavity 64 which is operable to receive or otherwise trap the immiscible or other contaminants 67 which may have become mixed or entrained with the source of the refrigerant 30(A) or 30(B) which is being provided to the refrigerant distributor 10 of the present invention. It will be understood by a study of FIG. 3 that any immiscible contaminants 67 and liquid phase refrigerant 30A1 are both delivered into the internal cavity 64 by the influence of gravity acting on same as they pass through the lower exhaust aperture 55 which is made integral with the second exhaust end 53 of the inlet conduit 50. The contaminants 67 settle to the bottom as shown in the drawing.

The contaminant collection container 60 has a first opened end 65, as seen in FIG. 3, and which is located in predetermined, spaced relation relative to the inside peripheral surface 14 of the tank 11. As such, and as illustrated in FIG. 3, the first end 65 is located substantially radially inwardly relative to the inside peripheral surface 14 of the tank 11. As will be recognized, the second exhaust end 53 of the inlet conduit 50 is located substantially coaxially inwardly relative to the first opened end 65 so that any immiscible contaminants 67 may be delivered directly into the internal cavity 64, and may not be delivered to the internal cavity 15 of the tank where the remaining refrigerant 30 is stored. As illustrated, liquid phase refrigerant 30A1 is also received in the contaminant collection container 60. Eventually, the liquid refrigerant 30A1 completely fills same and then spills out of the first end 65 and into the internal cavity 15 of the tank 11. As illustrated most clearly by reference to FIG. 3, the main body 61 of the contaminant collection container 60 has a second end 66 where the immiscible contaminants 67 settle-out and are collected. The main body 61 further has a bottom, or sidewall portion 70 which is sealingly affixed about its peripheral edge to the main body 61. Formed substantially centrally of the bottom or sidewall portion 70 is an aperture 71. As illustrated in the drawings, a threaded female nipple 72 is sealingly affixed within or occludes the aperture 71. Further, a threaded male drain plug 73 is operable to threadably couple with the threaded female nipple portion so as to retain the immiscible contaminant 67 in the internal cavity 64 of the main body 61. When appropriate, and at scheduled times, an operator, not shown, may remove the threaded male drain plug 73, and then remove the immiscible contaminants 67 from the contaminant collection container 60 thereby preventing the contaminants 67 from being subsequently delivered to any cooling device (not shown) which is coupled with the first and second forms of the invention 10(*a*) and 10(*b*) respectively.

Figure 6:
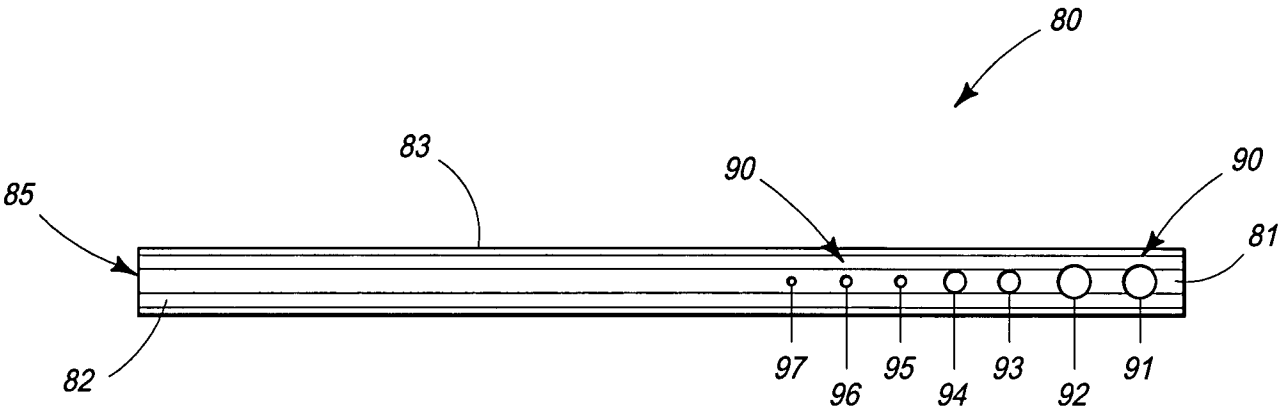
FIG. 6 is a side elevation view of a single refrigerant distributor conduit which is employed in the present invention.

Referring now to the drawings, and more specifically to FIGS. 3 through 6, it will be understood that the refrigerant distributor 10(*a*) or 10(*b*) of the prevent invention includes a plurality of refrigerant distributor conduits 80 which are operable to provide the source of refrigerant 30(*a*) or 30(*b*) to a downstream device or cooling apparatus of conventional design, and which is not shown. As illustrated most clearly in the sectional views of FIGS. 3 and 4, the plurality of refrigerant distributor conduits 80 each have a first end 81 which is received in the internal cavity 15, and which is received or otherwise positioned within the plurality of conduit seats 44 which are made integral with, or formed in the indexing plate 40. The respective refrigerator distributor conduits 80 also have a second, exhaust end 82 which is located outside of the tank 11. The second end 82 is coupled in fluid delivering relation relative to a cooling apparatus (not shown) which is positioned downstream thereof. Each of the refrigerant distributor conduits 80 has an outside facing surface 83, and an opposite inside facing surface 84 which defines a fluid passageway 85 which allows liquid or gaseous refrigerant 30A or 30B or a mixture thereof which is received in the internal cavity 15 to pass therethrough from the first end 81 and in the direction of the second end 82. As best illustrated in the longitudinal, sectional view of FIGS. 3 and 4, and the exploded view of FIG. 5, a multiplicity of apertures 90 are formed in each of the first ends 81 of the respective refrigerant distributor conduits 80. This multiplicity of apertures 90 each have a cross-sectional dimension or diametral dimensions which diminishes when that cross-sectional dimension is measured from the first intake end 81 of the respective refrigerant distributor conduits 80, and in the direction of the second exhaust end 82, thereof. As seen in FIG. 6, the multiplicity of apertures 90 have different diametral dimensions. These variably sized apertures 90 facilitate a variable flow of the source of refrigerant 30(A) or 30(B) out through the refrigerant distributor conduits 80 as the volume of the refrigerant in the tank 11 increases. The multiplicity of apertures 90 formed in the first end 81 of the respective refrigerant distributor conduits 80 includes first, second, third, fourth, fifth, sixth and seventh pairs of substantially coaxially aligned apertures. These respective pairs of apertures are indicated by the numerals 91, 92, 93, 94, 95, 96, and 97 respectively. With regards to these pairs of apertures 90, they have individual diametral dimensions which lie in a range of about 1.0 mm to about 5.0 mm.

As best seen by reference to FIGS. 3 and 4 it will be understood that the 7 pairs or apertures 90 are all located within the internal cavity 15 of the tank 11, and each pair of apertures 90 are located a given distance from the first end 81 thereof. In this regard, the first pair of apertures 91 are located at about 0.25 inches from the first end 81 thereof. Further, the second pair of apertures 92 are located at about 0.625 inches from the first end 81. Additionally, the third pair of apertures 93 are located at about 1 inch from the first end 81 thereof. The fourth pair of apertures 94 are located at about 1.3 inches from the first end 81 thereof. The fifth pair of apertures 94 are located at about 1.62 inches from the first end 81 thereof. The sixth pair of apertures 94 are located at a distance of about 1.93 inches from the first end 81 thereof; and the seventh pair of apertures 97 are located at a distance of about 2.25 inches from the first end 81 thereof. As best seen by reference to FIG. 6, the first and second pairs of apertures 91 and 92, respectively, each have a similar diametral dimension of about 0.187 inches. Further, the third and fourth pair of apertures 93 and 94 each have a similar diametral dimension of about 0.125 inches. Additionally, the fifth and sixth pair of apertures 95 and 96, each have a similar diametral dimension of about 0.0625 inches. Finally, the seventh pair of apertures has a similar diametral dimension of about 0.0469 inches. The applicant has discovered that the diametral dimensions as provided, above, including the spacing between the respective pair of apertures, provides a convenient means for controlling the flow of the refrigerant delivered from the internal cavity 15 of the tank 11 in a manner not possible, heretofore. The spacing between the pairs of apertures, and the diametral dimensions of the individual multiplicity of apertures 90 also provides a convenient means whereby the refrigerant distributor 10, and the attached cooling device, not shown, may be operated over a wider range of cooling loads not possible with refrigerant distributors constructed in accordance with the prior art teachings. As will be recognized by studying the drawings, the first ends of the 81 of the respective refrigerant distributor conduits 80 are located in substantially parallel, spaced relation, one relative to the others, and are substantially vertically oriented within the internal cavity 15 of tank 11.

OPERATION

The operation of the described embodiment of the present invention is believed to be readily apparent and is briefly summarized at this point.

In its broadest aspect a refrigerant distributor 10 of the present invention includes, as a first aspect, a tank 11 defining an internal cavity 15 for receiving a source of refrigerant 30 which is both in a liquid 30(A) or gaseous 30(B) or liquid and gaseous phase. The present invention also includes an inlet conduit 50 for delivering the source of the refrigerant 30 to the internal cavity 15 of the tank 11. The inlet conduit 50 has a first intake end 51 and a second exhaust end 53 which is located within the internal cavity 15 of the tank 11. The exhaust end 53 is defined by an upper 54 and a lower 55 exhaust aperture. The present invention 10 also includes a contaminant collection container 60 which is coupled in fluid receiving relation relative to the internal cavity 15 of the tank 11. The second exhaust aperture 55 of the inlet conduit 50 is disposed in fluid delivering relation relative thereto. In the present invention, a plurality of refrigerant distributor conduits 80 are coupled in fluid flowing relation relative to the internal cavity 15 of the tank 11. Each of the refrigerant distributor conduits 80 has a first intake end 81, and a second exhaust end 82. The first intake end 81 of the respective refrigerant distributor conduits 80 are substantially vertically oriented within the internal cavity 15 of the tank 11. A multiplicity of apertures 90 are formed in each of the first ends 81 of the respective refrigerant distributor conduits 80. The multiplicity of apertures 90 each have a cross-sectional or diametral dimension which diminishes when that cross-sectional or diametral dimension is measured from the first intake end 81 of the respective refrigerant distributor conduits 80 and in the direct of the second exhaust end 82 thereof.

By a review of the drawings it will be readily recognized that the tank 11 has a main body 12 which is defined by opposite ends 20, and the inlet conduit 50 sealingly extends through one of the opposite ends 20 of the tank and into the internal cavity 15 thereof. In the second form of the invention 10(*b*) as seen in FIG. 2, the inlet conduit 50 extends through the aperture 56 which is formed in the main body 12 of the tank 11. In the arrangement as shown in the drawings, the exhaust end 53 of the inlet conduit 51 comprises a T-shaped portion, and the upper exhaust aperture 54 is located on one side of the T-shaped portion, and is operable to direct the source of the refrigerant 30 into the internal cavity 15 of the tank 11, and the lower exhaust aperture 55 is located in a position opposite to the upper exhaust aperture 54 and is operable to direct any immiscible contaminants 67 which may be mixed with the source of the refrigerant 30 into the contaminant collection container 60. Further, refrigerant in a liquid phase 30A1 also passes into the contaminant collection container 60. As best recognized by study of FIGS. 3 and 4, the upper 54, and lower 55 exhaust apertures are substantially coaxially aligned. Additionally, and as noted earlier, the multiplicity of apertures 90 which are formed in the first intake end 81 of the respective refrigerant distributor conduits 80 each have a diametral dimension which lies in a range of about 0.0469 inches to about 0.187 inches. In addition to the foregoing, the tank 11 as shown in the drawings further includes a removable drain plug 73 which is releasably, threadably coupled to the contaminant collection container 60, and which permits any immiscible contaminants 67 delivered to the contaminant collection container 60 to be removed therefrom. In the drawings it will be seen that the contaminant collection container 60 has a main body 61 which has, opposite first 65 and second ends 66. The main body 61 of the contaminant collection container 60 is substantially vertically oriented, and the first end 65 of the contaminant collection container 60 is disposed in fluid receiving relation relative to the exhaust end 53 of the inlet conduit 50, and is further located, at least in part, within the internal cavity 15 of the tank 11. Still further the second end 66 of the contaminant collection container 60 is positioned outside of the tank 11 as seen clearly in FIG. 3.

The multiplicity of apertures 90 which are formed in the first end 81 of each of the refrigerant distributor conduits 80 includes pairs of substantially coaxial aligned apertures 90 some of which have different diametral dimensions. In the form of the invention as seen in the drawings, the first end 51 of the inlet conduit 50 for delivering the source of the refrigerant 30 has a first 51, and a second 52 intake for receiving the source of the refrigerant 30. As earlier discussed, the first intake 51 of the inlet conduit 50 solely receives the source of the refrigerant 30(A) during the refrigeration cycle. This source of refrigerant may include both liquid and/or gaseous phases. The second intake 52 solely receives the source of the refrigerant 30(B) during a hot gas defrost cycle. Typically the source of the refrigerant 30(B) is solely in a gaseous phase during the hot gas defrost cycle.

As earlier discussed, the tank 11 defines an internal cavity 15 for receiving the source of the refrigerant 30 which is both in a liquid and gaseous phase. The main body 12 is also defined by a horizontal/longitudinal axis 16, and a vertical or transverse axis which is generally indicated by the line labeled 17. An indexing plate 40 is affixed or otherwise attached by suitable fastening means to the main body 12 of the tank 11 and is mounted within the internal cavity 15 thereof. The indexing plate is further oriented in a predetermined, spaced, substantially parallel relationship relative to the horizontal axis 16 of the tank 11. In the present invention 10 a multiplicity of refrigerant distributor conduits 80, each of which has a first end 81, is affixed to the indexing plate 40, and are further located within the internal cavity of the tank 11. The respective refrigerant distributor conduits 80 also have an opposite, second end 82, which are located outside of the tank 11. The first end 81 of each of the refrigerant distributor conduits 80 are oriented in substantially parallel relation relative to the vertical axis 17 of the tank 11, and are also oriented in predetermined spaced relation one relative to the others. At least some of the first ends 81 of the respective refrigerant distributor conduits provide a variable flow of refrigerant 30 from the first 81 to the second ends 82 thereof.

A contaminant collection container 60 is coupled in fluid flowing relation relative to the tank 11, and is substantially vertically oriented relative thereto. The contaminant collection container 60 has a first, open end 65, which is located within the internal cavity 11, and is further perpendicularly oriented and inwardly spaced from the sidewall 63 which defines the tank 11. Still further, the contaminant collection container 60 has an opposite, second end 66, which is located outside the tank 11. Further, a releasable drain plug 73 is provided, and is otherwise releasably affixed to the second end 66 of the contaminant collection container 60. An inlet conduit 50 for delivering the source of the refrigerant 30 to the internal cavity 15 of the tank 11 is provided. The inlet conduit 50 has a first intake end 51 which is coupled in fluid receiving relation relative to the source of the refrigerant 30(A) during a refrigeration cycle, and a second intake end 52 which is coupled with the source of the refrigerant 30(B) during a defrosting cycle. The inlet conduit 50 has an opposite, second exhaust end 53 which is defined by a pair or exhaust apertures 54 and 55. The pair of exhaust apertures includes an upper exhaust aperture 54, and a lower exhaust aperture 55. The lower exhaust aperture 55 is oriented in fluid delivering relation relative to the first opened end 65 of the contaminant collection container 60. In this arrangement, any immiscible contaminants 67 which are mixed with the source of the refrigerant 30 which is in a liquid phase moves, under the influence of gravity, from the inlet conduit 50, and is received within the contaminant collection container 60. As discussed earlier, the source of the refrigerant 30 passes through both the upper and lower exhaust apertures 54 and into the internal cavity 15 defined by the tank 11.

As earlier discussed, at least one of the multiplicity refrigerant distributor conduits 80 has formed, in the first end 81 thereof, a multiplicity of apertures 90 which have predetermined diametral dimensions which facilitate a variable flow of the source of refrigerant 30 out through the refrigerant distributor conduits 80 as the volume of the refrigerant 30 and the tank 11 increases. As noted earlier, the source of the refrigerant 30 which is delivered to the internal cavity of the tank 11 departs therefrom to be delivered to a downstream cooling or air handling device (not shown), by way of the multiplicity of refrigerant distributor conduits 80, with greater volume as the overall volume of the refrigerant increases in the internal cavity 15 of the tank 11. In the arrangement as shown in the drawings, the multiplicity of apertures 90 comprises seven pairs of apertures which are all located within the internal cavity 15 of the tank 11. Each of the several pairs of apertures are located a given distance from the first end 81 of the respective refrigerant distributor conduits 80. These distances of the respective pairs of apertures from the first end 81 include a first pair of coaxially aligned apertures 91 which are located at about 0.25 inches therefrom. A second pair of apertures 92 which are located at a distance of about 0.625 inches therefrom. A third pair of apertures 93 which are located at a distance of about 1 inch thereof. A fourth pair of apertures 94 which are located at about 1.3 inches therefrom. A fifth pair of apertures 95 which are located at about 1.62 inches therefrom. A sixth pair of apertures 96 which are located at a distance of about 1.93 inches therefrom. And a seventh pair of apertures 97 which are located at a distance of about 2.25 inches therefrom. In the arrangement as best seen by reference to FIG. 6, the first and second pairs of apertures, 91 and 92, each have a diametral dimension of about 0.187 inches. Still further, the third and fourth pairs of apertures 93 and 94 each have a diametral dimension of about 0.125 inches. Moreover, as seen in the drawings, the fifth and sixth pairs of apertures 95 and 96 each have a diametral dimension of about 0.0625 inches. Finally, the seventh pair of apertures has a diametral dimension of about 0.0469 inches.

Therefore it will be seen that the present invention provides a novel refrigerant distributor having many advantages over the prior art devices which have been utilized heretofore. Further, the present refrigerant distributor 10 avoids many of the shortcomings of the prior art, and readily removes immiscible contaminants which commonly operably encumber other prior art refrigerant distributor designs, and further enhances the reliability of downstream cooling devices and assemblies which employ such refrigerant distributors.

In compliance with the patent statute, the present invention has been described in language more or less specific as to its structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the Doctrine of Equivalents.

I claim:

1. A refrigerant distributor comprising:

a source of refrigerant, and wherein the source of refrigerant includes an immiscible contaminant;

a tank defining an internal cavity for receiving the source of refrigerant which is both in a liquid, gaseous or liquid and gaseous phase;

an inlet conduit for delivering the source of the refrigerant to the internal cavity of the tank, and wherein the inlet conduit has a first intake end, and a second exhaust end which is located within the internal cavity of the tank, and wherein the exhaust end is defined by an upper exhaust aperture and a lower exhaust aperture;

a contaminant collection container coupled in fluid receiving relation relative to the internal cavity of the tank, and wherein the second, lower exhaust aperture of the inlet conduit is disposed in fluid delivering relation relative thereto, and wherein the contaminant collection container has a main body having opposite first and second ends, and wherein the main body of the contaminant collector extends through the sidewall which defines the tank, and wherein the second end of the contaminant collection container is positioned outside of the tank, and wherein the lower exhaust aperture is operable to direct under the influence of gravity the liquid phase of the source of refrigerant, which includes the immiscible contaminant, into the contaminant collection container, and wherein the immiscible contaminant separates from the refrigerant and the immiscible contaminant remains under the influence of gravity in the second end of the contaminant collection container, and wherein the liquid portion of the refrigerant which is substantially devoid of contaminant subsequently overflows into the tank from the first end of the contaminant collection container; and a plurality of refrigerant distributor conduits coupled in fluid flowing relation relative to the internal cavity of the tank, and wherein each of the refrigerant distributor conduits has a first intake end and a second exhaust end which is located outside of the tank, and wherein the first intake ends of the respective refrigerant distributor conduits are substantially vertically oriented within the internal cavity of the tank, and wherein a multiplicity of apertures are formed in each of the first ends of the respective refrigerant distributor conduits, and wherein each of the apertures has a cross-sectional dimension which diminishes as that cross-sectional dimension is measured from the first intake end of the respective refrigerant distributor conduits, and in the direction of the second exhaust end thereof.

2. A refrigerant distributor as claimed in claim 1, and wherein the tank has a main body defined by opposite ends, and wherein the inlet conduit sealingly extends through one of the opposite ends of the tank and into the internal cavity thereof.

3. A refrigerant distributor as claimed in claim 1, and wherein the exhaust end of the inlet conduit comprises a T-shaped portion, and the upper exhaust aperture is located on one side of the T-shaped portion, and is operable to direct the source of refrigerant in a gaseous phase into the internal cavity of the tank, and the lower exhaust aperture is located in a position opposite to the upper exhaust aperture.

4. A refrigerant distributor as claimed in claim 3, and wherein the upper and lower exhaust apertures are substantially coaxially aligned.

5. A refrigerant distributor as claimed in claim 1, and wherein the apertures formed in the first intake end of the respective refrigerant distributor conduits each has a diametral dimension which lies in a range of about 0.0469 inches to about 0.187 inches.

6. A refrigerant distributor as claimed in claim 1, and wherein the tank further comprises:

a removable drain plug which is releasably coupled to the second end of the contaminant collection container, and which permits the immiscible contaminant delivered to the contaminant collection container to be removed therefrom.

7. A refrigerant distributor as claimed in claim 1, and wherein the main body of the contaminant collection container is substantially vertically oriented, and the first end of the contaminant collection container is disposed in fluid receiving relation relative to the exhaust end of the inlet conduit.

8. A refrigerant distributor as claimed in claim 1, and wherein the apertures formed in the first end of each of the refrigerant distributor conduits include pairs of substantially coaxially aligned apertures each having substantially the same diametral dimension.

9. A refrigerant distributor as claimed in claim 1, and wherein the first end of the inlet conduit for delivering the source of refrigerant has a first and a second intake for receiving the source of the refrigerant, and wherein the first intake of the inlet conduit solely receives the source of refrigerant during a refrigeration cycle, and the second intake solely receives the source of refrigerant during a hot gas defrost cycle.

10. A refrigerant distributor, comprising:

a source of a refrigerant to be supplied to the refrigerant distributor, and wherein the source of the refrigerant, which may be in a liquid and/or gaseous phase, includes an immiscible contaminant;

a tank having a main body defined by a sidewall, and which further has opposite first and second ends, and wherein the tank additionally defines an internal cavity for receiving the source of the refrigerant which is in both a liquid and gaseous phase, and wherein the main body is also defined by a horizontal axis and a vertical axis;

an indexing plate attached to the main body of the tank, and which is mounted within the internal cavity thereof, and which is further oriented in a predetermined spaced, substantially parallel relationship relative to the horizontal axis of the tank;

a multiplicity of refrigerant distributor conduits, each of which has a first end which is affixed to the indexing plate, and are further located within the internal cavity of the tank, and an opposite, second end, which is located outside of the tank, and wherein the first end of each of the refrigerant distributor conduits is oriented in substantially parallel relation relative to the vertical axis of the tank, and is also oriented in predetermined spaced relation one relative to the other refrigerant distributor conduits, and and wherein a plurality of apertures are formed in each of the first ends of the respective refrigerant distributor conduits, and wherein each of the respective apertures of the individual refrigerant distributor conduits has a predetermined cross-sectional dimension which diminishes relative to an adjacent aperture as the cross sectional dimension is measured in a direction extending from the first end to the second end of the respective refrigerant distributor conduit;

a contaminant collection container coupled in fluid flowing relation relative to the tank and which is further vertically oriented relative thereto, and wherein the contaminant collection container has a first, open end, which is located within the internal cavity of the tank, and is further inwardly spaced from the sidewall of the tank, and an opposite second end, which is located outside of the tank, and wherein a releasable drain plug is affixed to the second end of the contaminant collection container; and an inlet conduit for delivering the source of the refrigerant to the internal cavity of the tank, and wherein the inlet conduit has a first intake end which is coupled in fluid receiving relation relative to the source of the refrigerant during a refrigeration cycle, and a second intake end which is coupled with the source of the refrigerant during a defrosting cycle, and wherein the inlet conduit has an opposite, second, exhaust end which is defined by a pair of exhaust apertures, and wherein the pair of exhaust apertures includes an upper exhaust aperture, and a lower exhaust aperture, and wherein the lower exhaust aperture is oriented in fluid delivering relation relative to the first, open end of the contaminant collection container, and wherein any the immiscible contaminant included with the source of refrigerant in a liquid phase moves, under the influence of gravity, from the inlet conduit, and is received within the contaminant collection container, and wherein the source of the refrigerant in either one or more of the liquid and gaseous phases passes, at least in part, through the upper and lower exhaust apertures, and into the internal cavity defined by the tank.

11. A refrigerant distributor as claimed by claim 10, and wherein the tank is oriented substantially symmetrically about the horizontal axis of the tank.

12. A refrigerant distributor as claimed in claim 10, and wherein the apertures facilitate a variable flow of the source of refrigerant out through each of the refrigerant distributor conduits as the volume of the refrigerant in the tank increases.

13. A refrigerant distributor as claimed in claim 10, and wherein the apertures formed in the first end of the of the refrigerant distributor conduits have a diametral dimension which lies in a range of about 0.0469 inches to about 0.187 inches.

14. A refrigerant distributor as claimed in claim 10, and wherein the source of the refrigerant which is delivered to the internal cavity of the tank departs therefrom, by way of the multiplicity of refrigerant distributor conduits, with increased volumetric flow as the overall volume of the refrigerant increases in the internal cavity of the tank.

15. A refrigerant distributor as claimed in claim 13, and wherein the apertures for each respective refrigerant distributor conduit comprise seven pairs of apertures which are all located within the internal cavity of the tank, and wherein each of the seven pairs of apertures are located a given distance from the first end of the respective refrigerant distributor conduits; and wherein these distances of the respective pairs of apertures from the first end include, a first pair of apertures which are located at about 0.25 inches therefrom; a second pair of apertures which are located at about 0.625 inches therefrom; a third pair of apertures which are located at about 1.0 inch therefrom; a fourth pair of apertures which are located at about 1.3 inches therefrom; a fifth pair of apertures which are located at about 1.62 inches therefrom; a sixth pair of apertures which are located at about 1.93 inches therefrom; and a seventh pair of apertures which are located at about 2.25 inches therefrom.

16. A refrigerant distributor as claimed in claim 15, and wherein the first and second apertures each have a diametral dimension of about 0.187 inches; the third and fourth pairs of apertures each have a diametral dimension of about 0.125 inches; the fifth and sixth pairs of apertures each have a diametral dimension of about 0.0625 inches; and the seventh pair of apertures has a diametral dimension of about 0.0469 inches.

17. A refrigerant distributor, comprising:

a source of a fluid refrigerant having both a liquid and a gaseous portion, and which further includes an immiscible contaminant which is admixed with the fluid refrigerant, and wherein the source of the fluid refrigerant is supplied to and utilized by a cooling device in a closed loop arrangement with the refrigerant distributor;

a tank coupled in fluid receiving relation relative to the source of the refrigerant having the immiscible contaminant, and which further has a sidewall which defines an internal cavity for receiving the fluid refrigerant having the immiscible contaminant;

an inlet conduit for delivering the source of the fluid refrigerant to the internal cavity of the tank, and wherein the inlet conduit has a first, intake end having a first inlet for receiving the fluid refrigerant during a refrigeration cycle from the cooling device, and a second inlet for receiving the fluid refrigerant during a hot-gas defrost cycle of the cooling device, and a second, exhaust end which has first and second exhaust apertures, and wherein the second exhaust end of the inlet conduit is located within the internal cavity of the tank;

a contaminant collection container coupled to the tank, and which is further disposed in both fluid receiving relation relative to the second exhaust end of the inlet conduit, and in fluid delivering relation relative to the internal cavity of the tank, and wherein the first exhaust aperture, as defined by the second, exhaust end of the inlet conduit, is disposed in fluid delivering relation relative to the internal cavity of the tank, and wherein the first exhaust aperture delivers the gaseous portion of the refrigerant into the internal cavity of the tank, and wherein the second exhaust aperture of the inlet conduit delivers the liquid portion of the refrigerant, and which has the immiscible contaminant, into the contaminant collection container, and wherein the contaminant collection container has a main body having opposite first and second ends, and wherein the main body of the contaminant collection container extends through the sidewall which defines the tank, and is further substantially vertically oriented relative to the tank, and wherein the first end of the contaminant collection container is disposed in fluid receiving relation relative to the second exhaust aperture, and which is defined by the second, exhaust end of the inlet conduit such that the liquid portion of the source of refrigerant flows into the contaminant collection container under the influence of gravity, and towards the second end of the contaminant collection container, and wherein the liquid portion of the refrigerant which fills the contaminant collection container, separates from the immiscible contaminant, under the influence of gravity, and wherein the separated immiscible contaminant moves under the influence of gravity towards the second end of the contaminant collection container, while the liquid refrigerant, which is now substantially devoid of the immiscible contaminant collects, and rises in the contaminant collection container, and wherein the liquid portion of the refrigerant, which is now substantially devoid of contaminant, subsequently overflows into the tank from the first end of the contaminant collection collector, and wherein the contaminant collection container is located, in part, within the internal cavity of the tank, and wherein the second end of the contaminant collection container is positioned outside of the internal cavity of the tank, and wherein the immiscible contaminant is periodically removed from the contaminant collection container through the second end thereof; and a plurality of refrigerant distributor conduits coupled in fluid receiving relation relative to the internal cavity of the tank, and wherein each of the refrigerant distributor conduits has a first, intake end which is located within the internal cavity of the tank, and a second exhaust end which is located outside of the tank, and which are further coupled in fluid delivering relation relative to the cooling device, and wherein the first intake ends of the respective refrigerant distributor conduits are located elevationally above the respective second exhaust ends, and wherein a plurality of apertures is formed in each of the intake ends of the respective refrigerant distributor conduits, and wherein each of the respective apertures of the individual refrigerant distributor conduits has a predetermined cross-sectional dimension which diminishes relative to an adjacent aperture when this cross sectional dimension is measured in a direction extending from the first intake end to the second exhaust end thereof of each of the respective refrigerant distributor conduits, and wherein the apertures having the predetermined cross sectional dimension selectively meter predetermined amounts of both the gaseous and liquid portions of the refrigerant, and which is substantially devoid of the contaminant, from the tank and supply the refrigerant to the cooling device.

18. The refrigerant distributor as claimed in claim 17, and wherein the refrigerant includes an ammonia-based compound.

19. The refrigerant distributor as claimed in claim 17, and wherein the second end of the contaminant collection container further includes a drain orifice and a removable drain plug removably coupled therein, and which facilitates contaminant removal from the contaminant collection container.

* * * * *